US005872580A

United States Patent [19]

Ochi et al.

[11] Patent Number: 5,872,580

[45] Date of Patent: Feb. 16, 1999

[54] INK JET RECORDING HEAD WITH STACKED INDIVIDUAL HEAD MEMBERS AND A MANUFACTURING METHOD THEREOF

[75] Inventors: Norihiro Ochi; Takahiro Horiuchi; Kazuya Koyama, all of Nara, Japan

[73] Assignee: Sharp Kabushiki Kaisha, Osaka, Japan

[21] Appl. No.: 754,529

[22] Filed: Nov. 21, 1996

[30] Foreign Application Priority Data

Nov. 21, 1995 [JP] Japan ..... 7-302712

[51] Int. Cl.[6] ..... B41J 2/145; B41J 2/15; B41J 2/045

[52] U.S. Cl. ..... 347/40; 347/71

[58] Field of Search ..... 347/40, 71, 68, 347/42, 37, 2, 3, 72

[56] References Cited

FOREIGN PATENT DOCUMENTS

| | | | |
|---|---|---|---|
| 62-198466 | 9/1987 | Japan . | |
| 63-4959 | 1/1988 | Japan | 347/71 |
| 4-278357 | 10/1992 | Japan | 347/40 |
| 4278357 | 10/1992 | Japan . | |
| 6-31923 | 2/1994 | Japan | 347/40 |

*Primary Examiner*—N. Le
*Assistant Examiner*—Thinh Nguyen

[57] ABSTRACT

An ink jet recording head includes a plurality of plate-like individual heads. Each individual head includes an individual head member having a main surface, a backside surface, a first side surface, and a plurality of second side surfaces. The first side surface includes a plurality of ink jet outlets aligned in a direction parallel to the main surface. Each individual head member includes a plurality of ink paths to supply ink to the plurality of ink jet outlets respectively. Each individual head includes a plurality of drive elements provided on the main surface corresponding to the plurality of ink paths respectively to generate pressure at the plurality of ink paths, and a plurality of electrodes provided corresponding to the plurality of drive elements to apply voltage individually to the plurality of drive elements. The plurality of electrodes have one ends connected to the plurality of drive elements, and the other ends arranged extending up to the neighborhood of any of the plurality of second side surfaces. The plurality of individual heads are stacked in a step-graded manner so that the other ends of the plurality of electrodes are exposed at the neighborhood of the second side surface.

40 Claims, 15 Drawing Sheets

INK JET RECORDING HEAD WITH STACKED INDIVIDUAL HEAD MEMBERS AND A MANUFACTURING METHOD THEREOF

BACKGROUND OF THE INVENTION

1. Field of the Invention

The present invention relates to an ink jet recording head and a method of manufacturing the same. Particularly, the present invention relates to an ink jet recording head with stacked individual head members and a method of manufacturing such an ink jet recording head.

2. Description of the Background Art

FIG. 1 is a front view of a conventional ink jet recording head. An ink jet recording head having individual head members stacked is disclosed in Japanese Patent Laying Patent Laying-Open No. 4-278357, for example. As shown in FIG. 1, such an ink jet recording head is constituted by having a plurality of individual head members stacked and inclined at an angle of θ1 with respect to a scanning direction X of the head.

Referring to FIG. 1, an ink jet recording head 200 includes a plurality of stacked individual heads 210. Each of the plurality of individual heads 210 includes a substrate 211 formed with a plurality of individual ink paths not shown and a plurality of thin holes 212 for discharging ink from respective individual ink paths provided at the front side of substrate 211. Each individual head 210 further includes a common electrode 213 at the top surface of substrate 211 so as to cover the individual ink paths, a plurality of electrostrictive elements 214 on common electrode 213 provided at corresponding positions of respective plurality of individual ink paths, and an individual electrode not shown provided on each of the plurality of electrostrictive elements 214.

In response to a record signal corresponding to record data from the main body of a recording device not shown, voltage is applied across each individual electrode of electrostrictive element 214 and common electrode 213. The selected electrostrictive element is deformed, whereby pressure is selectively generated in an individual ink path. Thus, ink is selectively discharged from thin hole 212 for recording.

In the above-described ink jet recording head, common electrode 213 only extends to the end of each layer of the ink jet recording head. The area of common electrode 213 facing the end portion of each layer is small. It is therefore not easy to connect common electrode 213 to the electrode element of the main body side in actually mounting the ink jet recording head to the main body of the recording device.

Since the electrodes of the second layer and of the upper layers are disposed between adjacent layers, the area of common electrode 213 facing the end of each layer becomes smaller as the distance between each individual head 210 becomes shorter. Therefore, connection with an external terminal is difficult to achieve.

Also, it is necessary to arrange the individual electrode for each of the plurality of electrostrictive elements corresponding to thin hole 212 from which ink is discharged. The number of individual electrodes is great. It is therefore extremely difficult to direct all these electrodes outside the recording head for connection with the electrode of the main body of the recording device.

Since the heads inclined as shown in FIG. 1 are stacked, the recording head can be reduced in size in the lateral direction of the figure. However, this will unnecessarily increase the recording head in the vertical direction, which is not desirable from the standpoint of reducing the size of the head.

An individual ink path is formed of common electrode 213 and substrate 211 as mentioned before. Common electrode 213 is conductive whereas substrate 211 is nonconductive. This means that the materials thereof differ. It is not easy to firmly connect different types of materials. There is high possibility of the adherence intensity of the contact surface being degraded since the contact surface is brought into contact with the ink in the individual ink path.

This induces a problem that ink cannot be discharged stably. There is also a problem that the lifetime of the recording head may be reduced.

SUMMARY OF THE INVENTION

An object of the present invention is to provide an ink jet recording head with a plurality of stacked plate-like individual heads forming a plurality of ink paths, wherein an electrode terminal of an ink jet recording head side and an electrode terminal of a recording device main body side can easily be connected in attachment to the recording device main body, and a manufacturing method thereof.

Another object of the present invention is to provide an ink jet recording head having a plurality of stacked plate-like individual heads forming a plurality of ink paths, wherein an electrode terminal of an ink jet recording head side can easily be connected to an electrode terminal of a recording device main body side in attachment to the recording device main body, and wherein ink can be discharged stably, and a manufacturing method thereof.

A further object of the present invention is to provide an ink jet recording head having a plurality of stacked plate-like individual head members forming a plurality of ink paths, wherein an electrode terminal of an ink jet recording head side can easily be connected to an electrode terminal of a recording device main body side in attachment to the recording device main body, and including an individual head of great strength, and a manufacturing method thereof.

Still another object of the present invention is to provide an ink jet recording head having a plurality of stacked plate-like individual head members forming a plurality of ink paths, wherein an electrode terminal of an ink jet recording head side can easily be connected to an electrode terminal of a recording device main body side in attachment to the recording device main body, and wherein the size of the ink jet recording head can be reduced, and a manufacturing method thereof.

A still further object of the present invention is to provide an ink jet recording head having a plurality of stacked plate-like individual heads forming a plurality of ink paths, wherein an electrode terminal of an ink jet recording head side can easily be connected to an electrode terminal of a recording device main body side in attachment to the recording device main body, and that allows reduction in the height of the head, and a manufacturing method thereof.

Yet a further object of the present invention is to provide an ink jet recording head having a plurality of stacked plate-like individual heads forming a plurality of ink paths, wherein an electrode terminal of an ink recording head side can easily be connected to an electrode terminal of a recording device main body side in attachment to the recording device main body, and can have an ink jet outlet corresponding to an ink path arranged within a constant range reasonably, and a manufacturing method thereof.

Yet another object of the present invention is to provide an ink jet recording head having a plurality of stacked plate-like individual heads forming a plurality of ink paths, wherein an electrode terminal of an ink recording head side can easily be connected to an electrode terminal of a recording device main body side in attachment to the recording device main body, and that allows recording of high accuracy.

Yet a still further object of the present invention is to provide an ink jet recording head having a plurality of stacked plate-like individual heads forming ink paths, wherein an electrode terminal of an ink jet recording head side can easily be connected to an electrode terminal of a recording device main body side in attachment to the recording device main body, and that allows proper arrangement of an ink jet outlet.

According to the present invention, an ink jet recording head includes a plurality of plate-like individual heads. Each of the plurality of individual heads includes a plate-like individual head member having a main surface, a backside surface, a first side surface, and a plurality of second side surfaces. The first side surface includes a plurality of ink jet outlets aligned in a direction parallel to the main surface. Each of the plurality of individual head members includes a plurality of ink paths for supplying ink to respective plurality of ink jet outlets. Each individual head further includes a plurality of drive elements at the main surface positioned corresponding to respective plurality of ink paths for generating pressure to respective plurality of ink paths, and a plurality of electrodes provided corresponding to the plurality of drive elements for applying voltage individually to the plurality of drive elements. The plurality of electrodes have one ends connected to respective plurality of drive elements and the other ends arranged extending up to the neighborhood of any of the plurality of second side surfaces. The plurality of individual heads are stacked in a step-graded manner so that the other ends of the plurality of electrodes are exposed at the neighborhood of the second side surface.

When voltage is applied individually to the other ends of the plurality of electrodes arranged extending to the neighborhood of any of the plurality of second side surfaces, the plurality of drive elements connected to respective one ends of the plurality of electrodes are driven to generate pressure in the ink paths corresponding to the plurality of drive elements. In response, ink is discharged through a corresponding ink jet outlet.

Since the plurality of individual heads are stacked in a step-graded manner so that the other ends of the plurality of electrodes are exposed at the neighborhood of the second side surface, the other ends of the plurality of electrodes are exposed in attaching the ink jet recording head to the recording device main body. Therefore, the electrode terminal of the recording device main body side can easily be connected to the electrode terminal of the ink jet recording head side.

Each of the plurality of individual head members preferably includes a substrate with a main surface having a plurality of first concaves forming respective walls of the plurality of ink paths and a backside surface, and a thin plate-like cover plate with a main surface and a backside surface, having the backside surface attached to the main surface of the substrate, and forming the plurality of ink paths with the wall.

When respective plurality of drive elements are driven to generate pressure in corresponding ink paths, ink is discharged from the jet outlet through the plurality of ink paths formed of the first concave of the substrate and the backside surface of the cover plate. Since the first concave of the substrate and the backside surface of the cover plate forming the plurality of ink paths are constituted by the same type of material, a firm attachment is allowed. Therefore, each individual head can discharge ink stably.

According to the present invention, a method of manufacturing an ink jet recording head includes a first step for manufacturing a plurality of stacked plate-like individual heads. Each of the plurality of individual heads includes a plate-like individual head member having a main surface, a backside surface, a first side surface, and a plurality of second side surfaces. Each of the plurality of individual head members includes a plurality of ink paths aligned in a direction parallel to the main surface with respect to the first side surface. Each of the plurality of individual heads includes a plurality of drive elements positioned on the main surface corresponding to respective plurality of ink paths for generating pressure to respective plurality of ink paths, and a plurality of electrodes provided corresponding to the plurality of drive elements for applying voltage individually to the plurality of drive elements. The plurality of electrodes have one ends connected to the plurality of drive elements and the other ends arranged extending up to the neighborhood of any of the plurality of second side surfaces. The plurality of individual heads are stacked in a step-graded manner so that the other ends of the plurality of electrodes are exposed at the neighborhood of the second side surface. The method of manufacturing an ink jet recording head further includes a second step for providing holes between the first side surface of the individual head and the plurality of ink paths manufactured at the first step to form a plurality of ink jet outlets.

Since the hole for forming an ink jet outlet is provided after the individual heads are stacked, the position of the ink jet outlet will not be deviated even if deviation is generated in sequentially stacking the individual heads. The ink jet outlet of the plurality of individual heads can be aligned properly. Thus, an ink jet recording head that can record at high accuracy can be manufactured.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention will be described hereinafter with reference to the drawings.

First Embodiment

Figure 1:
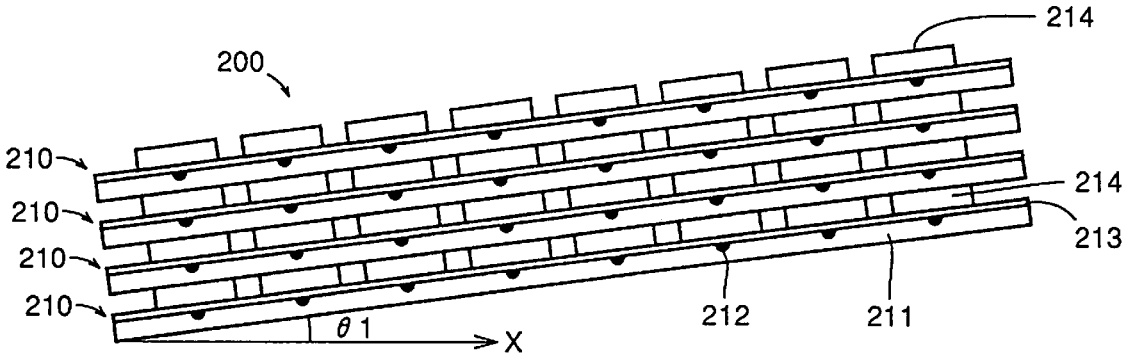
FIG. 1 PRIOR ART
FIG. 1, is a front view of a conventional ink jet recording head.
Figure 2:
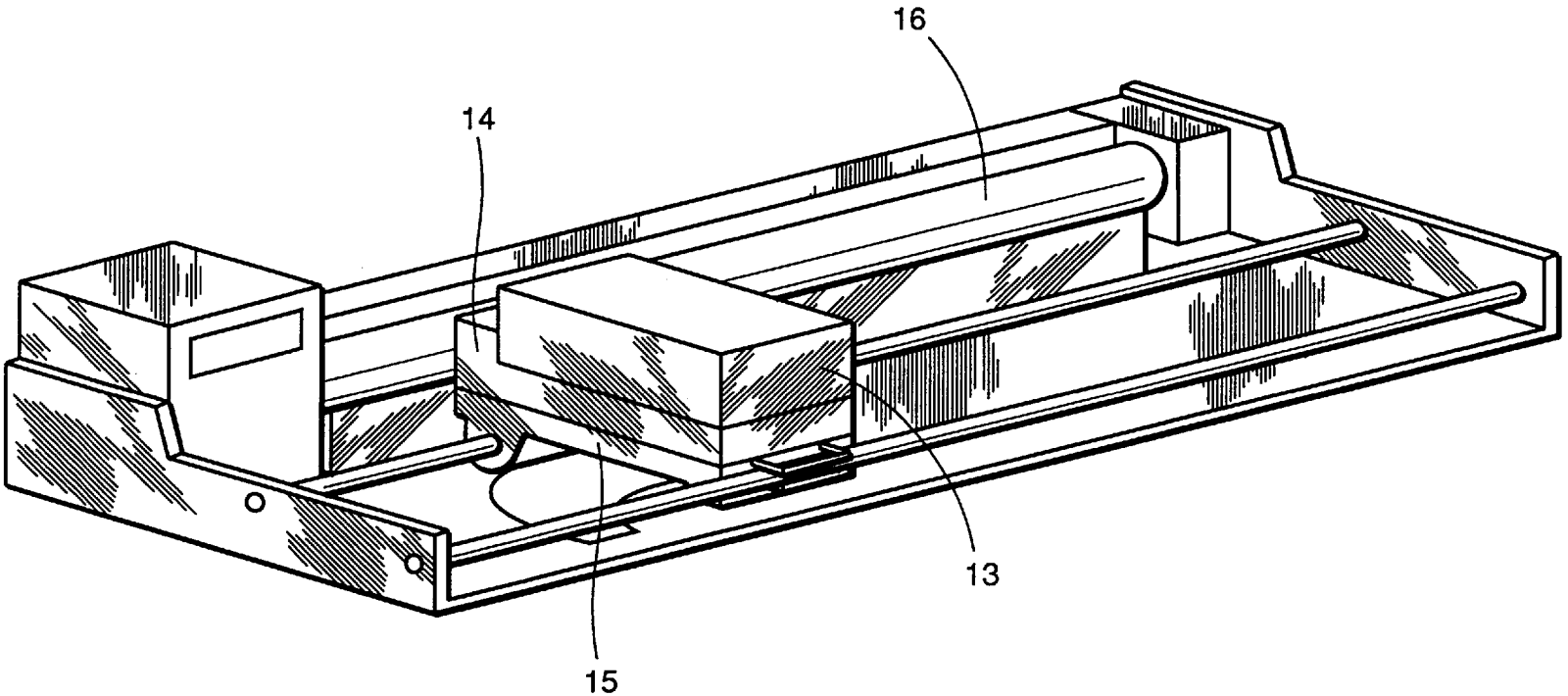
FIG. 2 is a perspective view of the appearance of a recording device main body having an ink jet recording head of the present invention mounted.

Referring to FIG. 2, a recording device main body includes an ink accommodation unit 13 for holding ink supplied to a recording head, a recording head fix base 14 for fixture of the recording head to connect the recording head and ink accommodation unit 13 by an ink path, a carriage 15 attached to recording head fix base 14 for reciprocating movement, and a platen 16 provided along the reciprocating movement path of carriage 15 for holding and conveying a recording sheet. Recording is carried out on a recording sheet not shown wrapped around platen 16 by the recording head.

Figure 3:
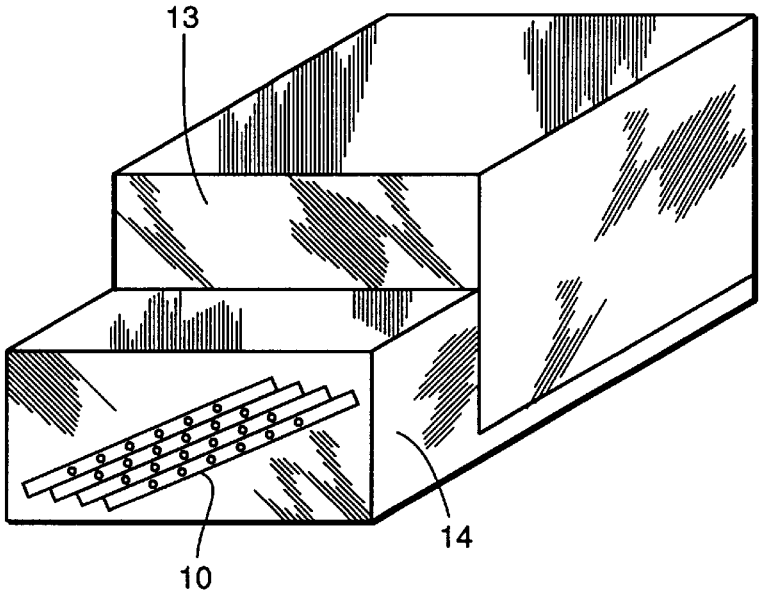
FIG. 3 is a perspective view showing the appearance of an ink jet recording head and a peripheral member of the present invention.
Figure 4:
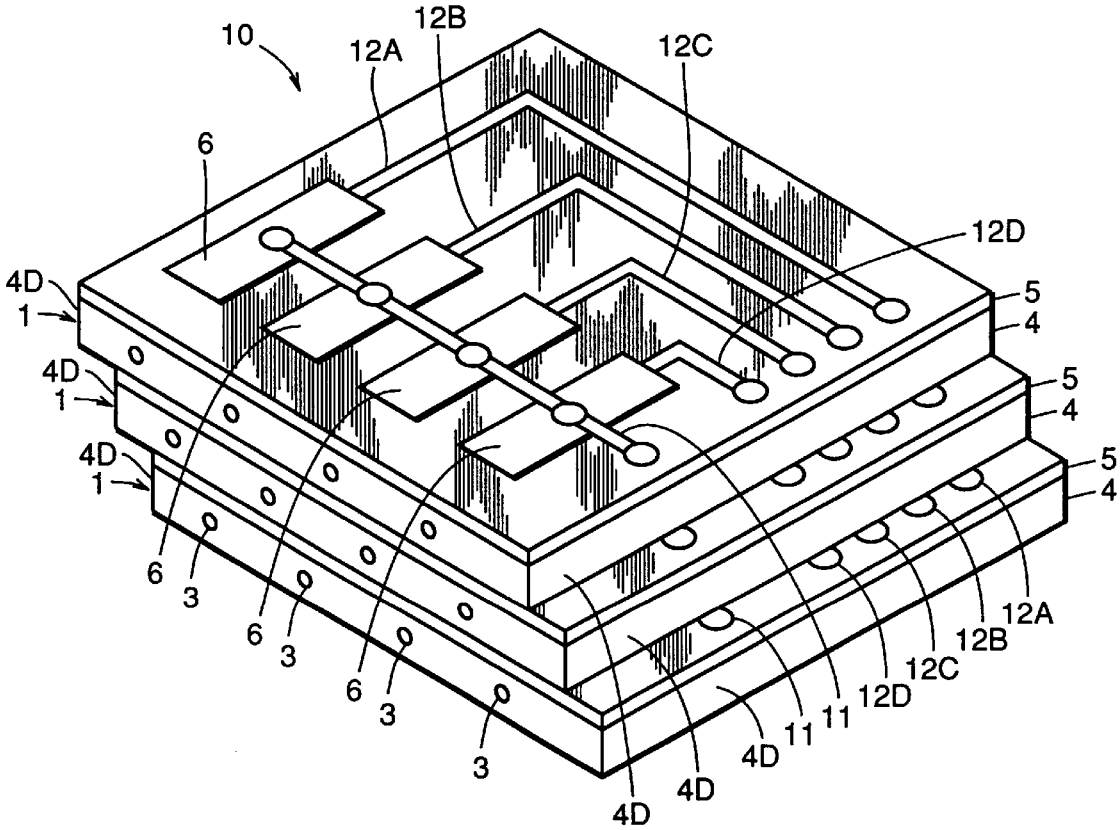
FIG. 4 is a perspective view of an ink jet recording head according to a first embodiment of the present invention.
Figure 5:
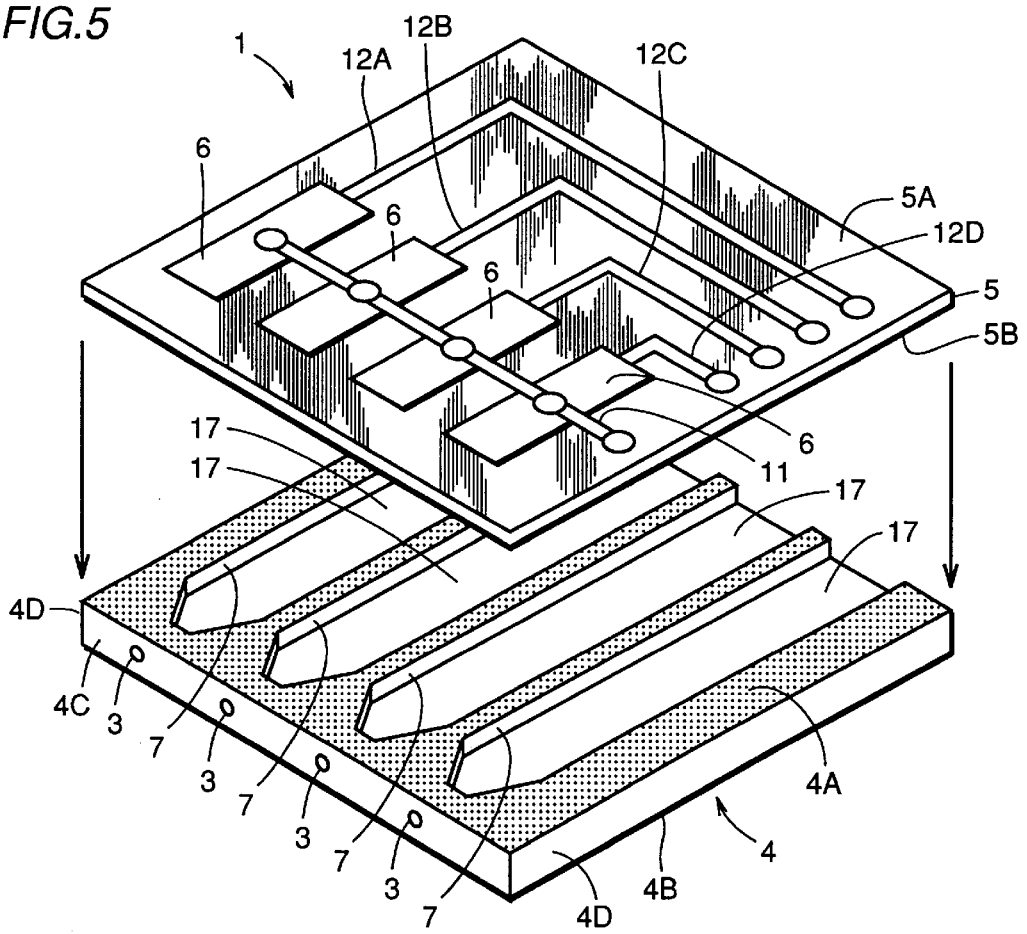
FIG. 5 is a diagram for describing the structure of an individual head according to the first embodiment.

FIG. 3 shows recording head fix base 14 viewed from the platen 16 side. Recording head 10 is fixed so as to be enclosed by fix base 14 connected to ink accommodation unit 13. Electrode terminals of the recording head side and the recording device main body side are connected in fix base 14.

The structure of recording head 10 will be described in detail with reference to FIGS. 4, 5, 6, 7, 8 and 9.

Recording head 10 includes a plurality of individual heads 1 stacked in discrete steps in a stepwise manner. Each individual head 1 includes a plate-like individual head member. Each individual head member includes a substrate 4 with a main surface 4A having a plurality of first concaves 7 for forming respective wall surfaces of a plurality of ink paths 17 and a back side surface 4B, and a thin cover plate 5 having a main surface 5A and a backside surface 5B. Cover plate 5 has backside surface 5B attached to main surface 4A of substrate 4 to form a plurality of ink paths 17 together with concave 7. Each individual head 1 further includes a plurality of drive elements 6 on main surface 5A respectively positioned corresponding to the plurality of ink paths 17 to generate pressure to respective ink paths, and a plurality of electrodes 11, 12A, 12B, 12C and 12D for applying voltage individually to the plurality of drive elements 6.

Each substrate 4 includes a front side surface 4C and a side surface 4D. Front side surface 4C includes a plurality of ink jet outlets 3 aligned in a direction parallel to main surface 4A. Electrodes 11A, 12A–12D have their one ends connected to the plurality of drive elements 6 respectively, and the other ends arranged extending to the neighborhood of side surface D respectively. The plurality of individual heads 1 are stacked in a step-graded manner so that the other ends of electrodes 11 and 12A–12D are exposed at the neighborhood of side surface 4D. Each substrate 4 includes a plurality of concaves 8 at backside surface 4B positioned corresponding to respective drive elements 6 of an adjacent individual head 1. Concave 8 is greater in size than drive element 6. Although individual heads 1 having four ink jet outlets are shown in FIGS. 4–8, the actual number of ink jet outlets is not limited to the illustrated 4.

Figure 6:
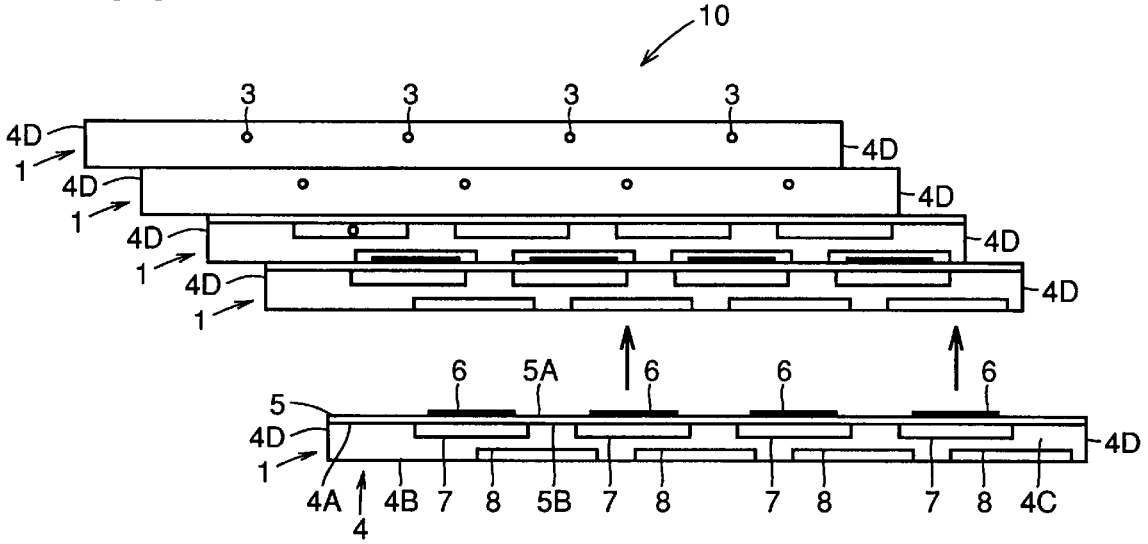
FIG. 6 is a diagram for describing the stacked state of individual heads according to the first embodiment.
Figure 7:
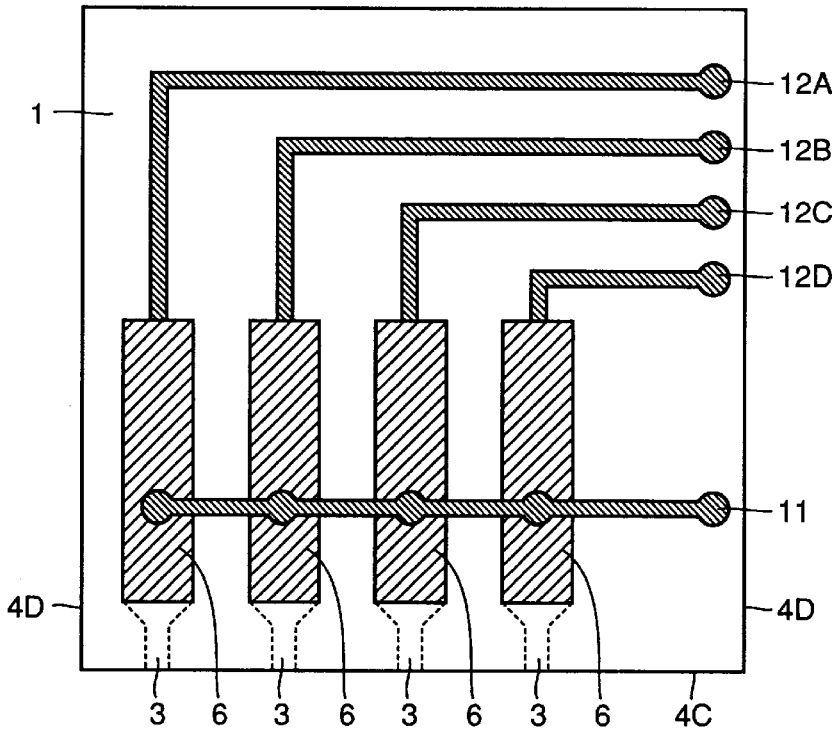
FIGS. 7 and 8 are diagrams for describing the arrangement of electrodes on an individual head according to the first embodiment.
Figure 8:
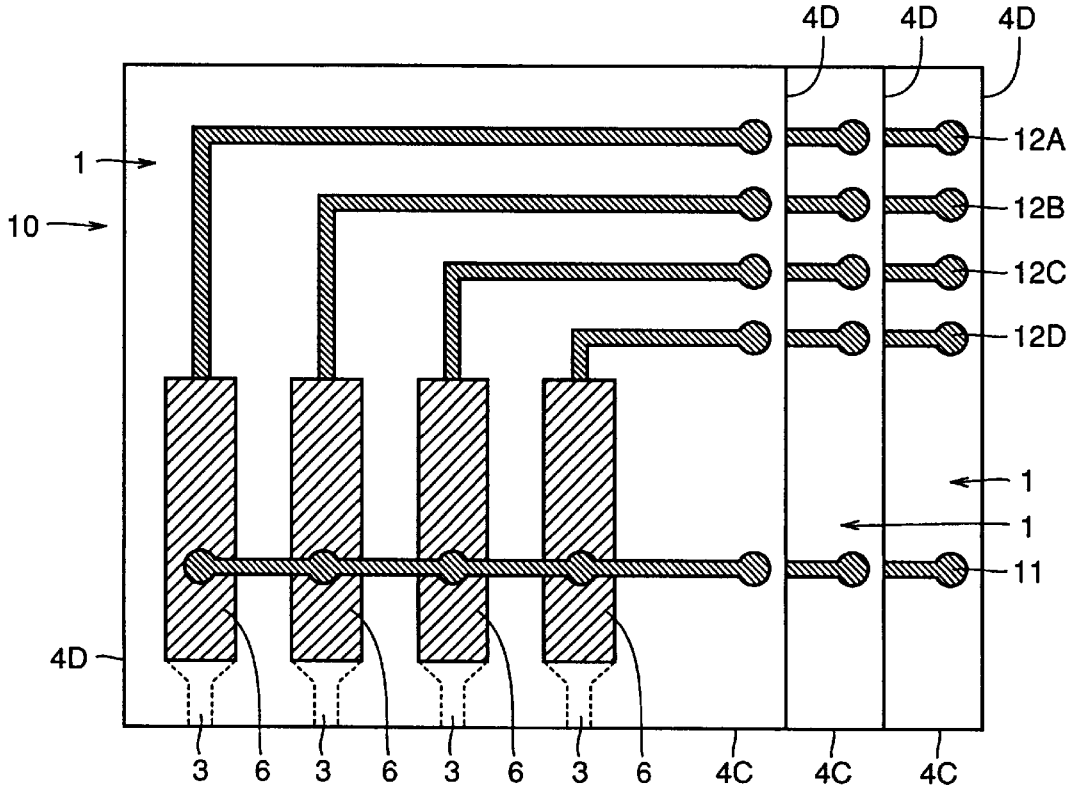

FIG. 7 is a plan view of the arrangement of the electrodes provided in individual head 1 of recording head 10 of FIG. 6. Individual electrodes 12A, 12B, 12C and 12D are provided corresponding to respective drive elements 6 in individual head 1. Furthermore, a common electrode 11 connected to all drive elements 6 is provided. FIG. 8 is a plan view of individual heads 1 sequentially stacked in a step-graded manner as in FIG. 6. The terminals of individual electrodes 12A, 12B, 12C, 12D and also the terminal of common electrodes 11 provided at each individual head 1 are exposed outside recording head 10. Accordingly, connection of an electrode terminal of the recording device main body side and an electrode terminal of the recording head side is facilitated.

Figure 10:
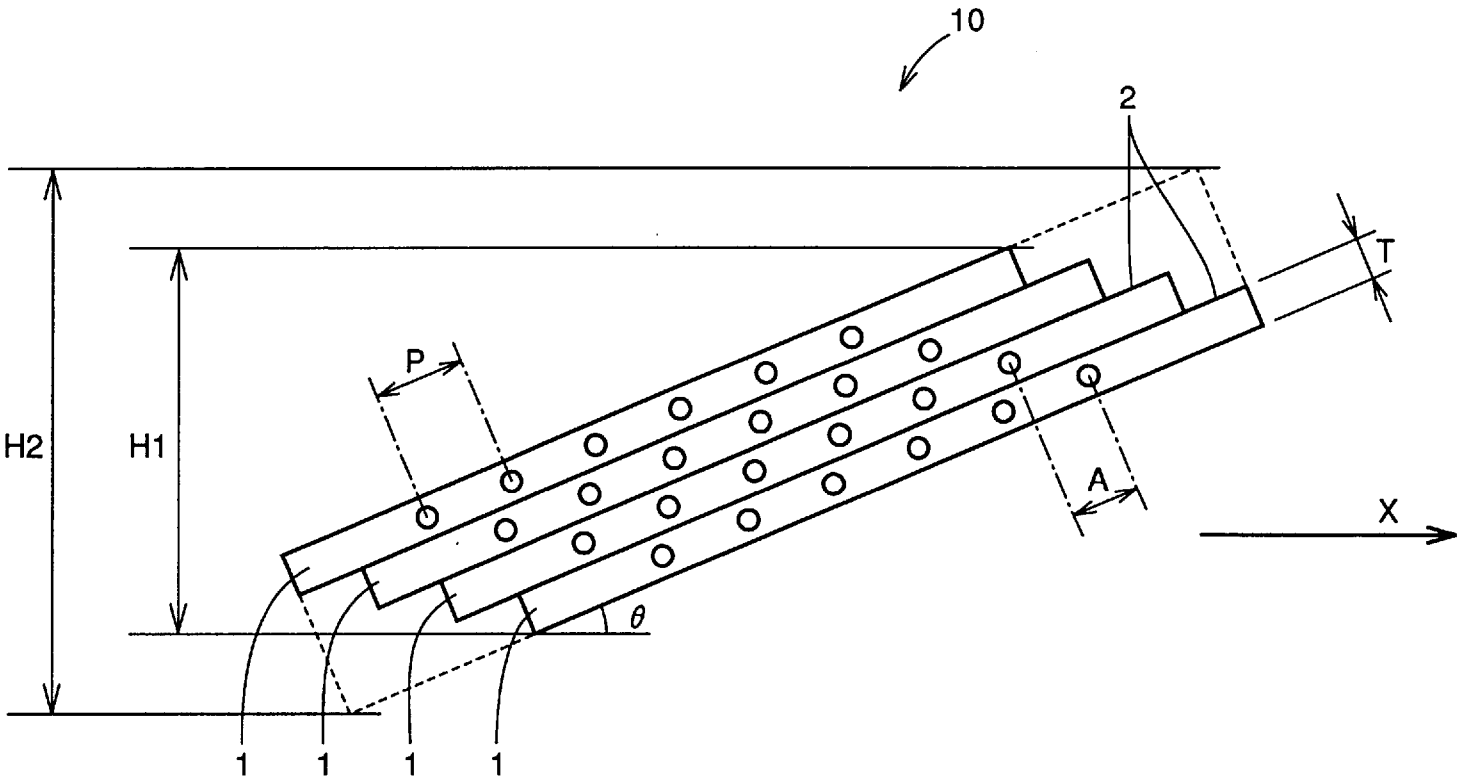
FIGS. 10 and 11 are front views of an ink jet recording head of the first embodiment showing alignment of ink jet outlets.

Referring to FIG. 10, thickness T of individual head 1 of recording head 10 is 400 $\mu$m, and pitch P of ink jet outlets is 980 $\mu$m. With 23 individual heads 1 stacked as four layers, the total number of ink jet outlets is 92. The shifted amount A of each individual head position is 2035 $\mu$m, and the inclination $\theta$ with respect to head scanning direction X is 9.95°=0.174 rad to realize a resolution of 600 dpi. For the sake of simplification, the illustrated number of ink jet outlets do not match the aforementioned numeral. Individual head member 1 are stacked so that either ends are shifted in a step-graded manner. Since the distance from an ink jet outlet from both sides of each individual head 1 to respective ends of individual head 1 is 1 mm, the lateral width and height of recording head 10 are 29 mm and 4.7 mm, respectively (corresponding to dimension H1 in FIG. 10).

When individual heads 1 are not stacked in a step-graded manner, the contour of recording head 10 is as shown by the broken line in FIG. 10, and the height of recording head 10 is H2=6 mm. This means that recording head 10 can be reduced in size when stacked in a step-graded manner.

Figure 11:
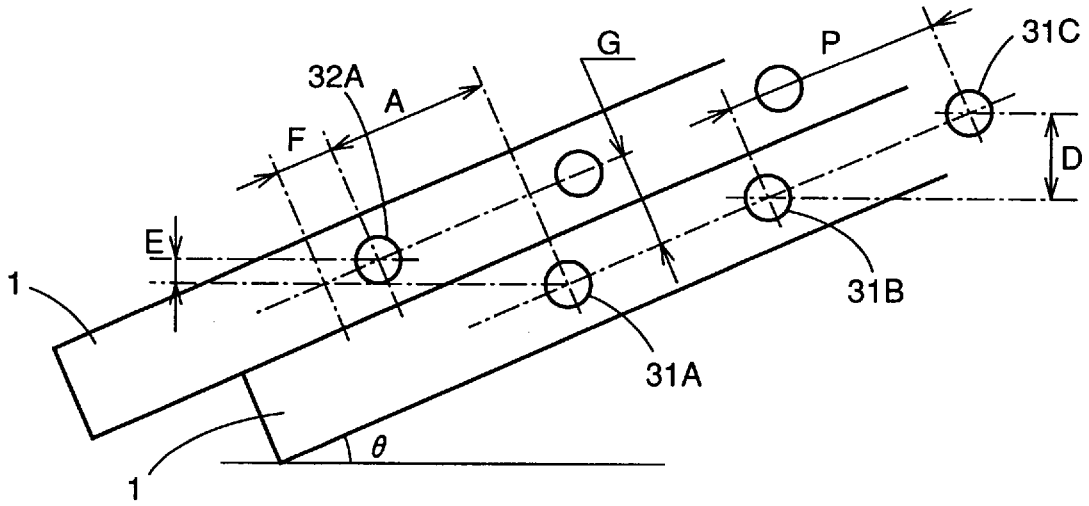

FIG. 11 is a partially enlarged view of FIG. 10. Ink jet outlets of individual head 1 are provided so that the arrangement thereof satisfies the following equation. This equation shows the positioning relationship of two adjacent ink jet outlets in the same layer, for example the positioning relationship between ink jet outlets 31B and 31C shown in FIG. 11.

$$\theta=\sin^{-1}(25400\cdot N/P\cdot X)$$

where

P [$\mu$m]: pitch of ink jet outlets arranged in a row in individual head member X [dpi]: resolution in recording N [layers]: number of stacked layers of individual heads $\theta$ [rad]: angle between the scanning direction of recording head (perpendicular to the direction of transportation of recording sheet) and the alignment of ink jet outlets of each individual head)

This equation is derived from $$D=25400\cdot N/X$$

where D [μm] is the distance between outlets 31B and 31C in the vertical direction, and from $$\sin\theta=P/D$$

as apparent from FIG. 11.

The ink jet outlets are also formed so that the arrangement of the ink jet outlets of another layer of individual head meets the following equation.

$$A=(T/\tan\theta)-(P/N)$$

where

T [μm]: thickness of individual head

A [μm]: shifted amount of each of the step-graded individual heads

This equation indicates the positioning relationship of ink jet outlets of each lowest position in adjacent layers, for example, the positioning relationship between ink jet outlets 31A and 32A. This equation is derived from the following relationship of FIG. 11.

$$E=25400/X$$

$$\sin\theta=E/F$$

Since the thickness of each layer is T [μm], the relationship of G=T is satisfied.

Also, since the shifted amount of each individual head is A [μm], the relationship of $$\tan\theta=G/(F/A)$$

where

E [μm]: distance between ink jet outlets of the most lowest position in adjacent layers in the vertical direction F [μm]: distance between ink jet outlets at each lowest position in adjacent layers as shown in FIG. 11

G [μm]: distance between each ink jet outlets in adjacent layers in stacked direction is met.

Figure 9:
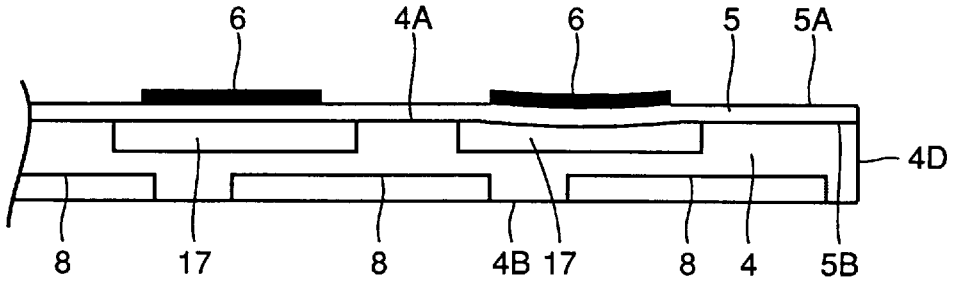
FIG. 9 is a diagram for describing an operation of the individual head of the first embodiment.

Referring to FIGS. 9 and 7, by generating a potential difference between a common electrode and an individual electrode via an electrode terminal of the main body side, cover plate 5 deflects inward ink path 17 as shown by the rightside ink path in FIG. 9 since driving element 6 forms a unimorph with cover plate 5. In response, ink is pushed outwards by the pressure generated in ink path 17. Ink is discharged according to the timing of a signal applied via the electrode terminal of the main body side.

Substrate 4 and cover plate 5 are assembled by adherence. The material of the substrate forming an ink recording head is typically a resin type such as polyether sulfone, metal class, glass class, and the like. When a substrate and a common electrode are adhered as in the structure of a conventional recording head, it is difficult to achieve firm adherence since they are formed of different types of materials. By forming an individual head member with a substrate and a cover plate as in the present embodiment, both components can be formed of the same type of material. Also, the same type of adhesive agent for attachment thereof can be used. Thus, an extremely firm adherence can be provided.

The fact that both are formed of the same type of material also provides the advantage that deformation of the member in temperature variation caused by difference in the linear expansion coefficient can be suppressed. Thus, a recording head of a constant dimension precision can be provided.

Figure 12:
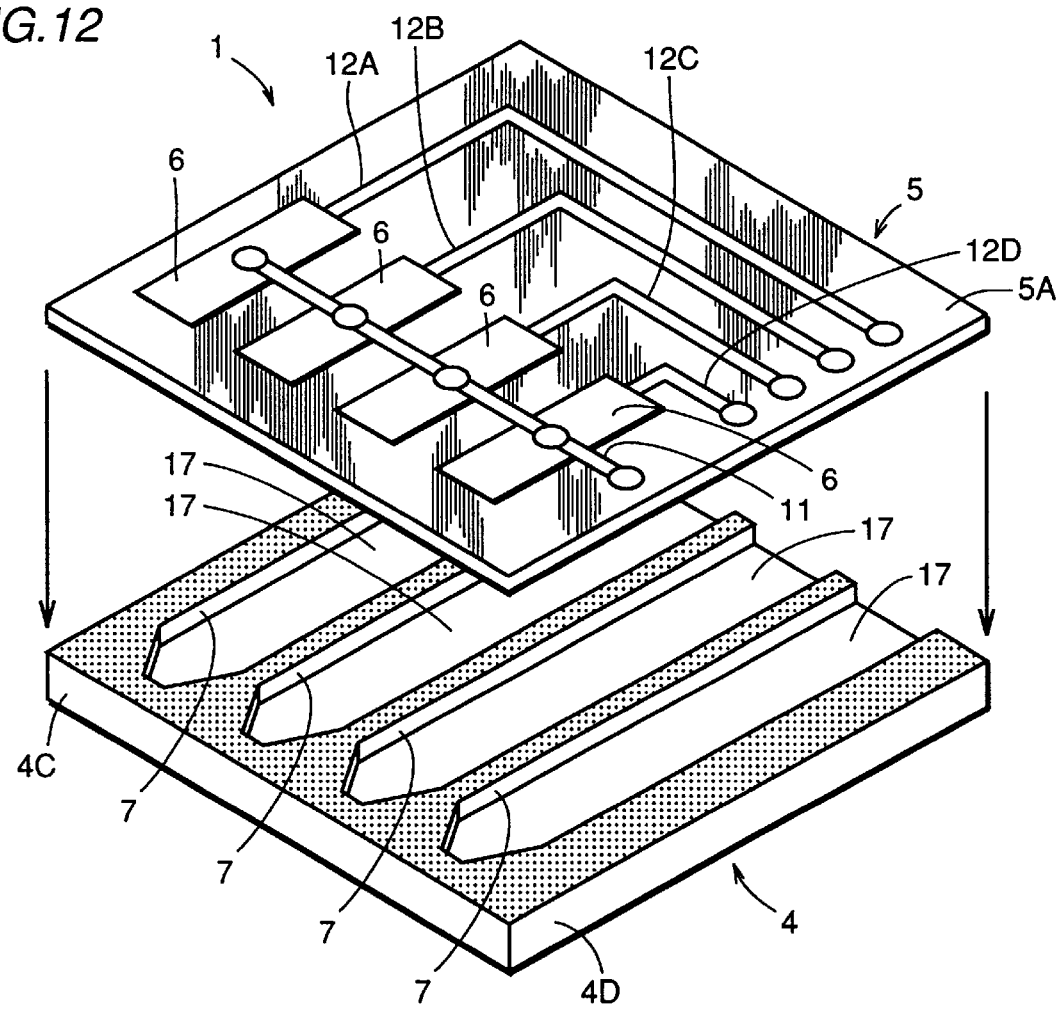
FIG. 12 is a diagram for describing a method of manufacturing an individual head according to the first embodiment.
Figure 13:
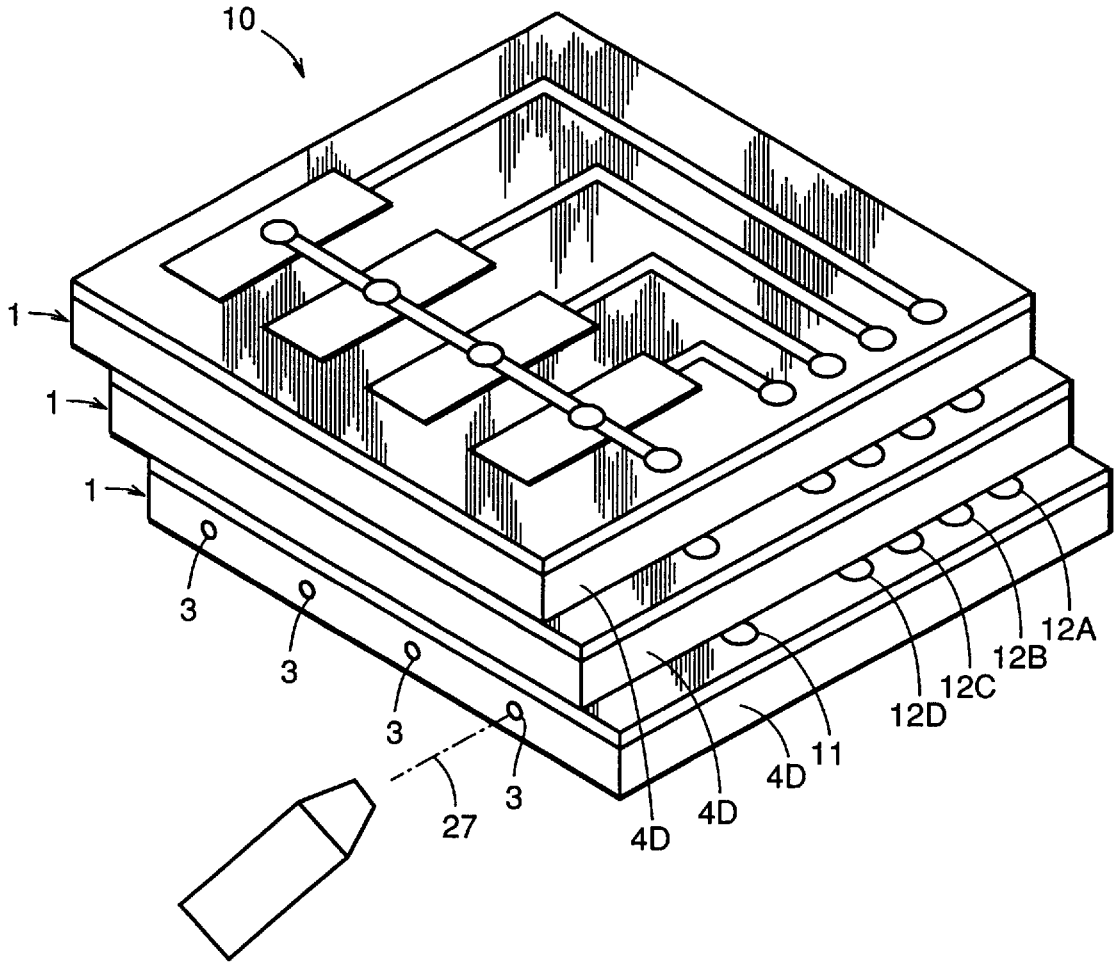
FIG. 13 is a diagram for describing a method of forming an ink jet outlet of the ink jet recording head of the first embodiment.
Figure 14:
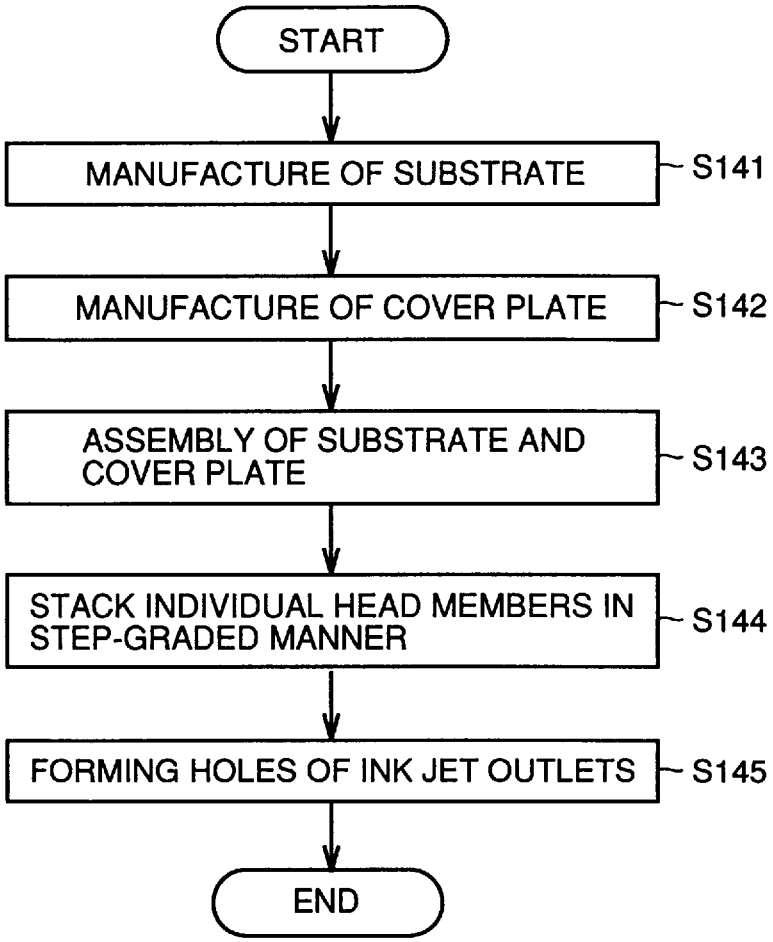
FIG. 14 is a flow chart of a manufacturing method of the ink jet recording head of the first embodiment.
Figure 15:
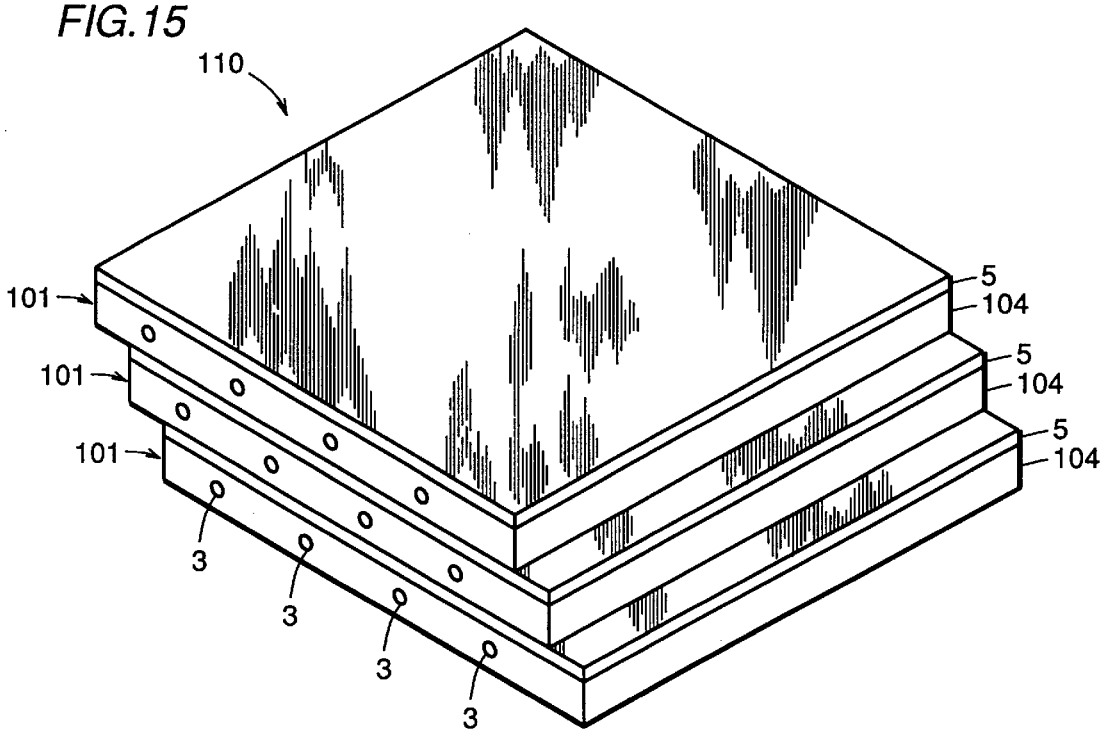
FIG. 15 is a perspective view of an ink jet recording head according to a second embodiment of the present invention.
Figure 16:
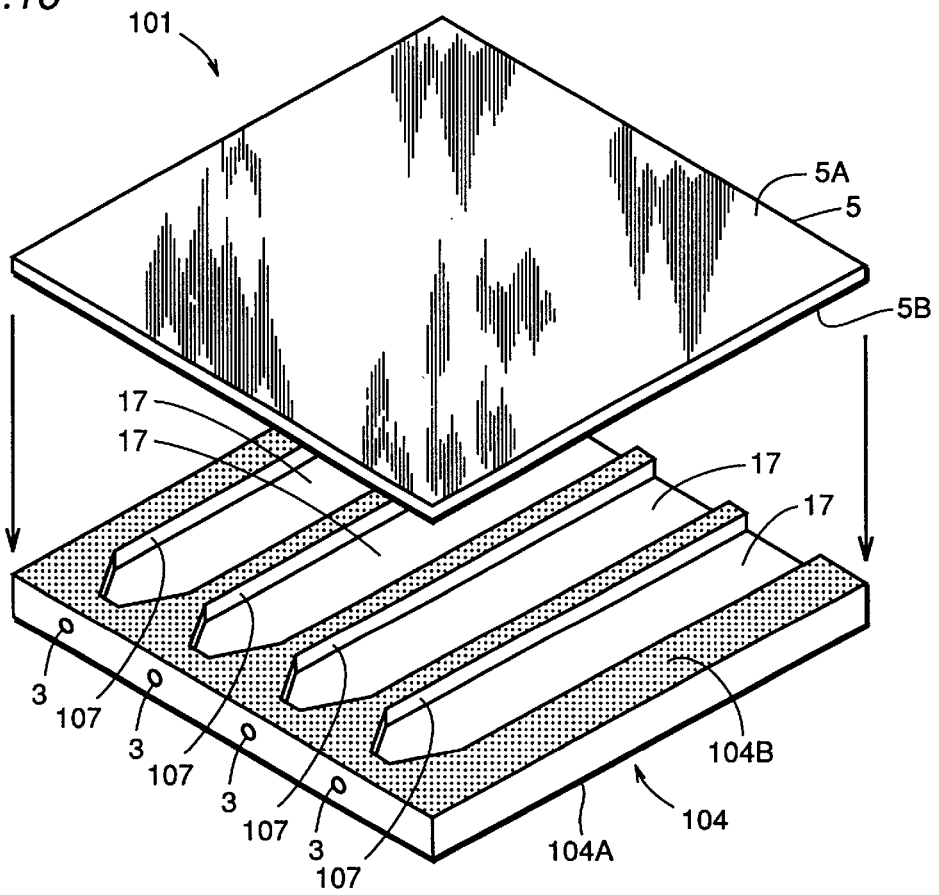
FIG. 16 is a diagram for describing a structure of an individual head of the second embodiment.

A method of manufacturing the ink jet recording of the first embodiment will be described hereinafter with reference to FIGS. 12, 13 and 14. First, a plurality of substrates 4 of polyether sulfone including a plurality of concaves 7 for forming a plurality of ink paths 18 are manufactured (S141). Ink jet outlets are not yet provided, so that ink path 17 does not yet open towards side surface 4C. At main surface 5A, a plurality of cover plates 5 of polyether sulfone are provided with a plurality of drive elements 6 and a plurality of deposited electrodes 11, 12A, 12B, 12C and 12D thereon (S142). Substrate 4 and cover plate 5 are attached with an epoxy type sheet to assemble individual head 1 (S143). Then, a plurality of individual heads 1 are stacked in a step-graded manner so that the terminals of the plurality of electrodes 11, 12A, 12B, 12C and 12D are exposed at the neighborhood of side surface 4D (S144). An ink jet outlet 3 is formed at a predetermined position by an excimer laser beam 27 (S145). Thus, an ink jet recording head is manufactured.

The employed laser beam is excimer laser using mixture gas of Kr and F with a wavelength of 248 nm. A non-heating process is allowed since the excimer laser is gas laser using mixture gas of Ar and F or Kr and F, and has a pulse wave of a wavelength in the ultraviolet range. Furthermore, since the energy inherent to the wavelength matches the bond energy of polymer and the like, the member, if of a resin material, can be worked by decomposing the member to a molecular level without heating. Thus, accurate working is allowed without deformation and transformation of the processing portion. Furthermore, working can be effected without producing residues.

Specifically, a substrate and a cover plate are formed of resin material, and each ink jet outlet is formed using excimer laser. The problem of residues of the material in forming an ink jet outlet entering the recording head can be eliminated. A recording head with no distortion caused by heat can be manufactured. Usage of an excimer laser provides the advantage that face working is allowed which is another feature of excimer laser. A plurality of ink jet outlets can be formed simultaneously by using a mask therein. Thus, the time required for forming an ink jet outlet can be shortened.

According to the first embodiment, the electrode terminal portion of each individual head is led out the recording head and exposed. Therefore, connection between an electrode terminal of the ink jet recording head and an electrode terminal of a recording device main body is facilitated.

Furthermore, since the individual heads are stacked in a slopelike manner, the drive elements of adjacent ink paths in the stacked direction will not come close to each other. Therefore, the problem of crosstalk can be avoided. Since each of the individual head is stacked so that the end portion is stepwise, the height of the head can be reduced. Each individual head can be assembled by firm adherence. This ensures capping to protect the recording head when not in a recording operation, whereby drying of ink from the ink jet outlet due to vaporization is avoided.

Arrangement is provided for the ink jet outlets of the same layer and ink jet outlets between adjacent layers to satisfy predetermined positioning relationships. Alignment of ink jet outlets is achieved properly to allow recording at high accuracy. Since ink jet outlets can be aligned within a constant range reasonably, the recording head can be reduced in size without extra space.

Since ink jet outlets are formed after individual heads are stacked, ink jet outlets can be aligned at predetermined positions accurately even if deviation occurs of the individual heads in sequential stacking thereof. Thus, a recording head that allows recording at high accuracy can be provided.

Second Embodiment

A second embodiment of the present invention will be described hereinafter with reference to FIGS. 15, 16, 17, 18, 19 and 20. Components of the ink jet recording head of the second embodiment corresponding to those of the first embodiment have the same reference characters allotted, and details thereof will not be repeated.

Figure 17:
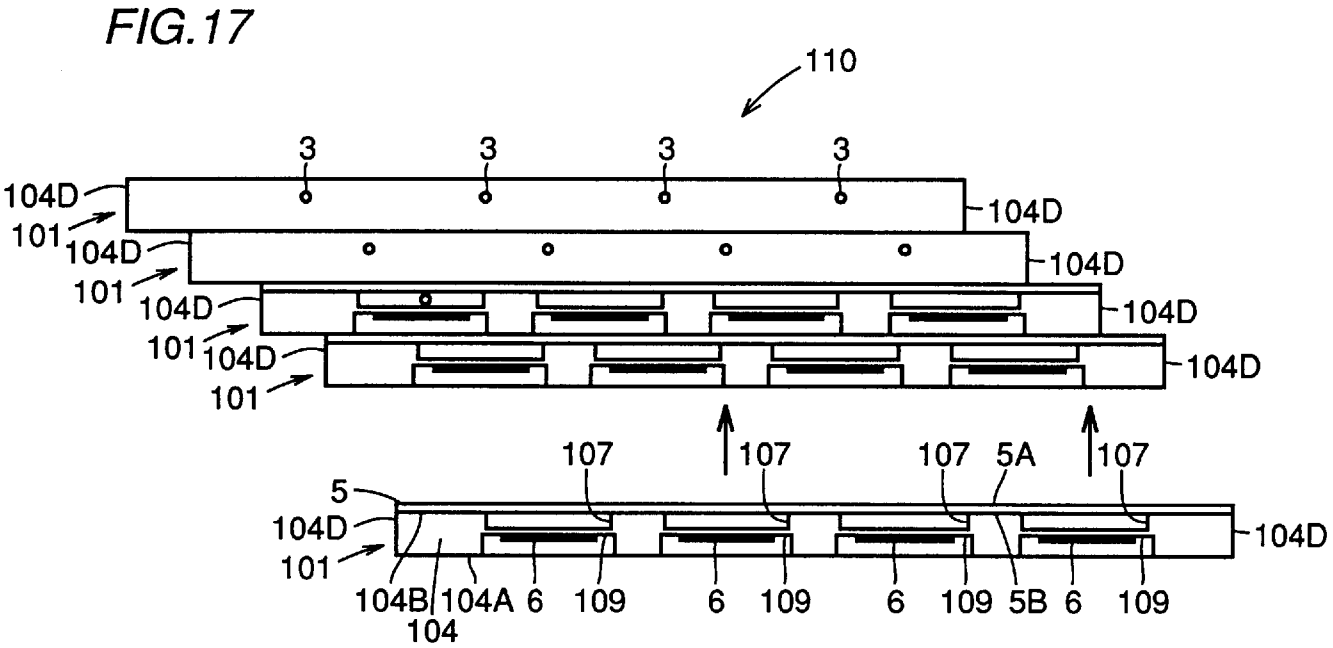
FIG. 17 is a diagram for describing a stacked state of individual heads of the second embodiment.

The ink jet recording head of the second embodiment differs from the ink jet recording head of the first embodiment in that the surface of the substrate where the driving elements and electrodes are provided differ. Each of a plurality of individual heads 101 of an ink jet recording head 110 of the second embodiment includes a substrate 104 instead of substrate 4. Electrodes 11, 12A, 12B, 12C and 12D are provided at a surface 104A of substrate 104 located opposite to cover plate 5. Surface 104A includes a concave 109 as shown in FIG. 17. Drive element 6 is provided at concave 109. In contrast to the first embodiment where drive element 6 and cover plate 5 form a unimorph to generate pressure in ink path 17, drive element 6 forms a unimorph with the thin body portion of concave 107 and concave 109 of substrate 104 to generate pressure in ink path 17 in the second embodiment. Common electrode 11 and individual electrodes 12*a*–12*d* are provided on main surface 104A in a manner similar to that of the first embodiment described with reference to FIGS. 7 and 8.

Figure 18:
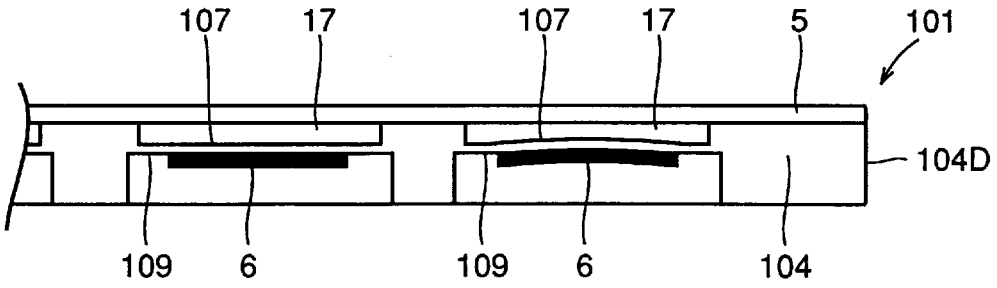
FIG. 18 is a diagram for describing an operational state of individual heads according to the second embodiment.
Figure 19:
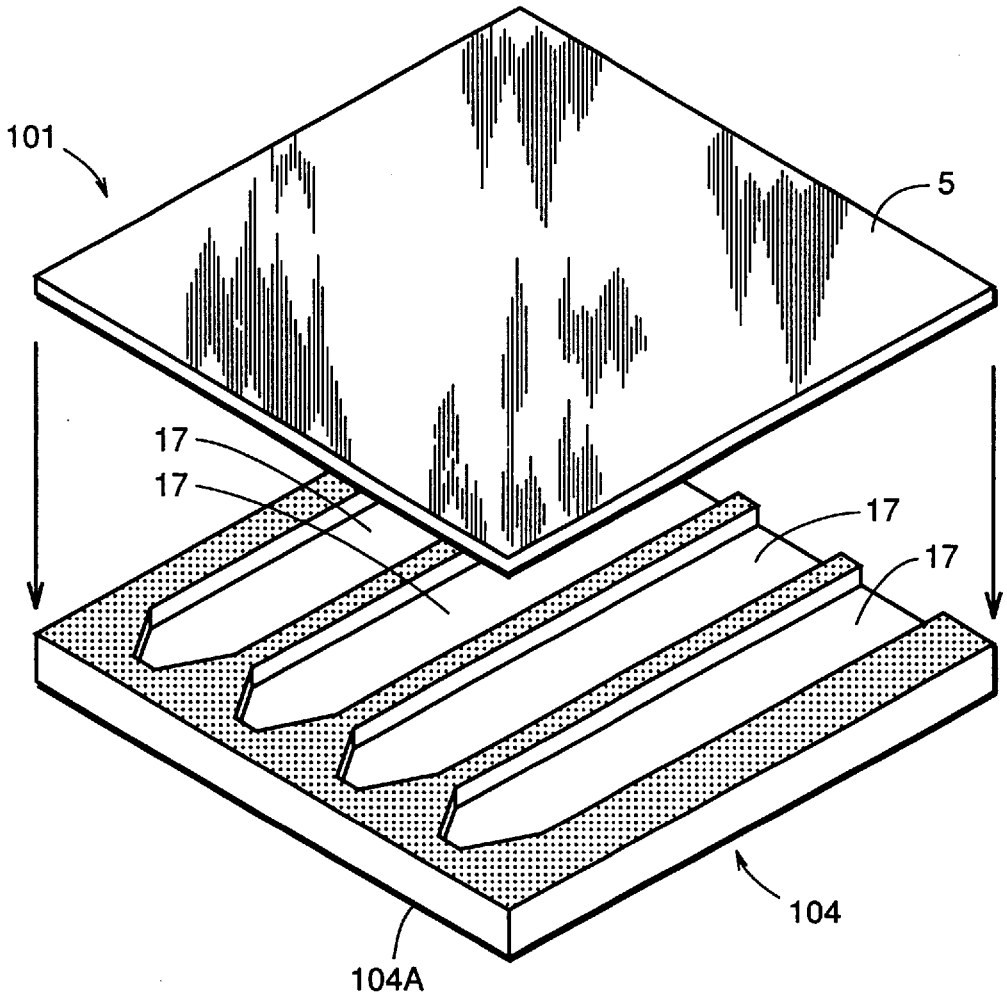
FIG. 19 is a diagram for describing a method of manufacturing the individual head of the second embodiment.
Figure 20:
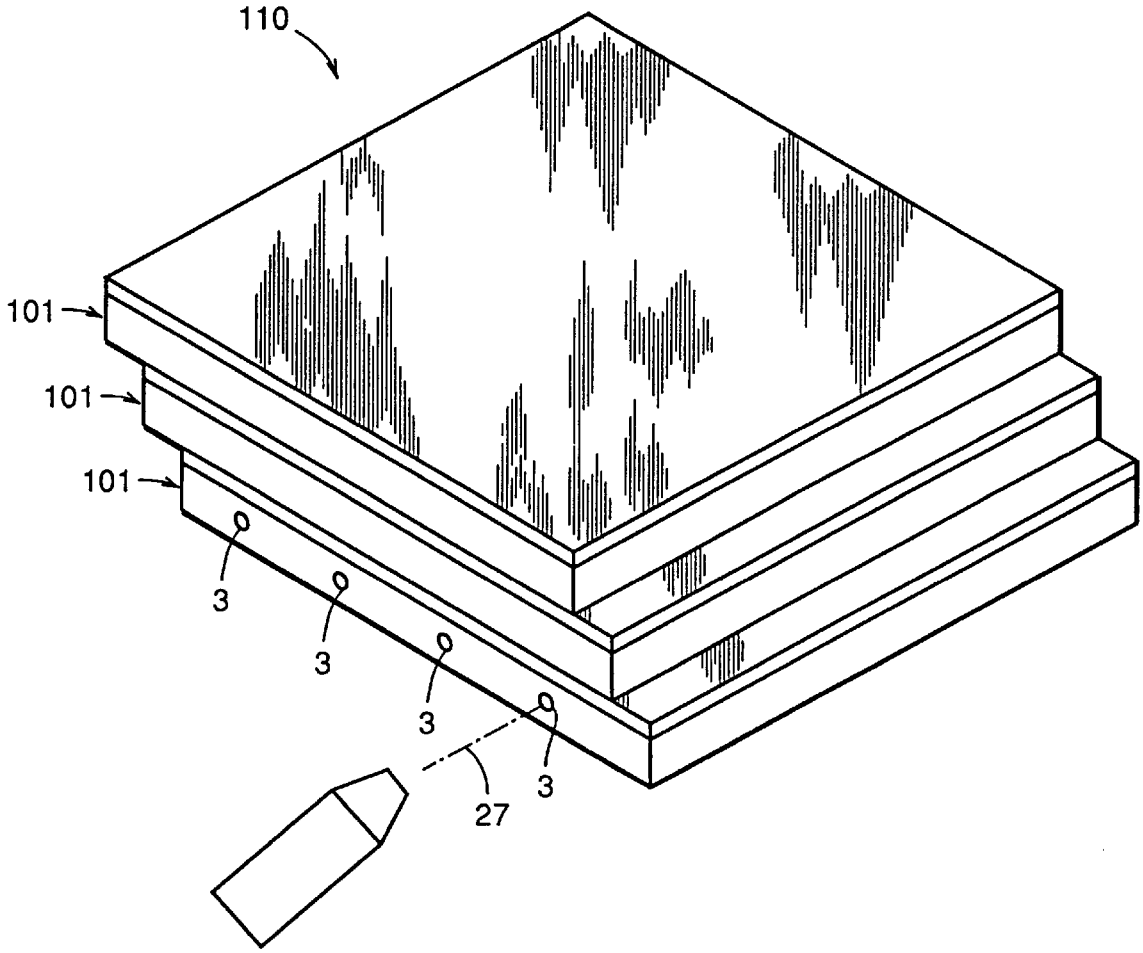
FIG. 20 is a diagram for describing a method of forming an ink jet outlet of an ink jet recording head of the second embodiment.

By generating a potential difference between the common electrode and the individual electrode, the thin body portion is deflected inwards of ink path 17 as in the rightside ink path 17 of FIG. 18 since drive element 6 forms a unimorph with the thin body portion of substrate 104. In response, ink in ink path 17 is pushed. Ink is ejected by a timing of a signal applied via the electrode terminal of the recording device main body.

According to the second embodiment, the electrode terminal portion provided at a surface of the substrate of each individual head opposite the cover plate is led outside the recording head to be exposed. This facilitates connections between an electrode terminal of the ink jet recording head and an electrode terminal of the recording head device main body.

Since each individual head is stacked in a sequentially shifted manner, drive elements of adjacent ink paths in the stacked direction will not come close to each other to avoid the problem of crosstalk. Since respective individual heads are stacked so that the end portion is stepwise, the height of the head can be reduced. Also, each individual head can be assembled by firm adherence. This ensure capping to protect the recording head in a non-recording state to prevent ink from being vaporized from the ink jet outlet.

Ink jet outlets are arranged so that two ink jet outlets of the same layer and of adjacent layers meet predetermined positioning relationships. Alignment of ink jet outlets is provided properly to allow recording at high accuracy. Since the ink jet outlets can be aligned within a constant range efficiently, the recording head can be reduced in size with no extra space.

Since an ink jet outlet is formed after individual heads are stacked, the ink jet outlets can be provided accurately at predetermined positions even if deviation occurs in sequentially stacking the individual head members. Thus, an ink jet recording head that allows recording at high accuracy can be provided.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An ink jet recording head comprising a plurality of plate-like individual heads, wherein each of said plurality of individual heads comprises:

a plate-like individual head member including a main surface, a first side surface, and a plurality of second side surfaces, said first side surface including a plurality of ink jet outlets arranged parallel to said main surface, each of said plurality of head members including a plurality of ink paths for supplying ink to said plurality of ink jet outlets respectively, and further wherein each of said plurality of individual heads comprises a plurality of drive elements positioned at said main surface corresponding to said plurality of ink paths for generating pressure in respective said plurality of ink paths, and a plurality of electrodes provided corresponding to said plurality of drive elements for applying a voltage individually to said plurality of drive elements, wherein said plurality of electrodes have one ends connected to said plurality of drive elements, respectively, and the other ends arranged extending to a neighborhood of any of said plurality of second side surfaces, wherein said plurality of individual heads are stacked in a step-graded manner so that the other ends of said plurality of electrodes are exposed at the neighborhood of said second side surface.

2. The ink jet recording head according to claim 1, wherein each of said plurality of individual head members comprises a substrate including a main surface having a plurality of first concaves forming a wall of said plurality of ink paths and a backside surface, and a cover plate including a main surface and a backside surface, said backside surface attached to said main surface of said substrate, and forming said plurality of ink paths with said wall.

3. The ink jet recording head according to claim 2, wherein said main surface of said cover plate forms a main surface of said individual head, and said drive elements deflect said cover plate to generate pressure at respective said plurality of ink paths.

4. The ink jet recording head according to claim 3, wherein said substrate includes a plurality of second concaves at a backside surface, greater in size than said drive element, at a position corresponding to respective said drive elements of an adjacent individual head.

5. The ink jet recording head according to claim 4, wherein said ink jet recording head is arranged to satisfy a relationship of $$\theta=\sin^{-}(25400\cdot N/P\cdot X)$$

$$A=(T/\tan\theta)-(P/N)$$

where

P (μm) is a pitch of said plurality of ink jet outlets,

X (dpi) is a resolution at recording,

N (layers) is the number of stacked layers of said plurality of individual heads, θ (rad) is an angle between a scanning direction of said ink jet recording head and an alignment direction of said ink jet outlets of said individual head, T (μm) is a thickness of said individual head, and A (μm) is a shifted amount in stacking said individual heads.

6. The ink jet recording head according to claim 3, wherein said ink jet recording head is arranged to satisfy the relationship of $$\theta=\sin^{-1}(25400\cdot N/P\cdot X)$$

$$A=(T/\tan\theta)-(P/N)$$

where

P (μm) is a pitch of said plurality of ink jet outlets,

X (dpi) is a resolution at recording,

N (layers) is the number of stacked layers of said plurality of individual heads, θ (rad) is an angle between a scanning direction of said ink jet recording head and an alignment direction of said ink jet outlets of said individual head, T (μm) is a thickness of said individual head, and A (μm) is a shifted amount in stacking said individual heads.

7. The ink jet recording head according to claim 2, wherein said main surface of said cover plate is said main surface of said plate-like individual head member, and said backside surface of said substrate is a backside surface of said plate-like individual head member.

8. The ink jet recording head according to claim 2, wherein said ink jet recording head is arranged to satisfy the relationship of $$\theta=\sin^{-1}(25400\cdot N/P\cdot X)$$

$$A=(T/\tan\theta)-(P/N)$$

where

P (μm) is a pitch of said plurality of ink jet outlets,

X (dpi) is a resolution at recording,

N (layers) is the number of stacked layers of said plurality of individual heads, θ (rad) is as angle between a scanning direction of said ink jet recording head and an alignment direction of said ink jet outlets of said individual head, T (μm) is a thickness of said individual head, and A (μm) is a shifted amount in stacking said individual heads.

9. The ink jet recording head according to claim 1, wherein each of said plurality of individual head members comprises a substrate including a backside surface having a plurality of first concaves for forming respective walls of said plurality of ink paths, and a main surface, and a thin cover plate including a main surface and a backside surface, said backside surface being attached to the backside surface of said substrate, and forming said plurality of ink paths together with said walls.

10. The ink jet recording head according to claim 9, wherein said main surface of said substrate forms a main surface of said individual head, said plurality of drive elements are provided at a plurality of second concaves formed at a position corresponding to said plurality of ink paths respectively of said substrate, and each of said plurality of drive elements deflects a plurality of thin body portions between said plurality of first concaves and said second concaves to generate pressure at respective said plurality of ink paths.

11. The ink jet recording head according to claim 10, wherein said ink jet recording head is arranged to satisfy the relationship of $$\theta=\sin^{-1}(25400\cdot N/P\cdot X)$$

$$A=(T/\tan\theta)-(P/N)$$

where

P (μm) is a pitch of said plurality of ink jet outlets,

X (dpi) is a resolution at recording,

N (layers) is the number of stacked layers of said plurality of individual heads, θ (rad) is an angle between a scanning direction of said ink jet recording head and an alignment direction of said ink jet outlets of said individual head, T (μm) is a thickness of said individual head, and A (μm) is a shifted amount in stacking said individual heads.

12. The ink jet recording head according to claim 9, wherein said ink jet recording head is arranged to satisfy the relationship of $$\theta=\sin^{-1}(25400\cdot N/P\cdot X)$$

$$A=(T/\tan\theta)-(P/N)$$

where

P (μm) is a pitch of said plurality of ink jet outlets,

X (dpi) is a resolution at recording,

N (layers) is the number of stacked layers of said plurality of individual heads, θ (rad) is an angle between a scanning direction of said ink jet recording head and an alignment direction of said ink jet outlets of said individual head, T (μm) is a thickness of said individual head, and A (μm) is a shifted amount in stacking said individual heads.

13. The ink jet recording head according to claim 1, wherein said ink jet recording head is arranged to satisfy the relationship of $$\theta=\sin^{-1}(25400\cdot N/P\cdot X)$$

$$A=(T/\tan\theta)-(P/N)$$

where

P (μm) is a pitch of said plurality of ink jet outlets,

X (dpi) is a resolution at recording,

N (layers) is the number of stacked layers of said plurality of individual heads, θ (rad) is an angle between a scanning direction of said ink jet recording head and an alignment direction of said ink jet outlets of said individual head, T (μm) is a thickness of said individual head, and A (μm) is a shifted amount in stacking said individual heads.

14. A plurality of plate-like individual heads for use in an ink jet recording head, each individual head comprising:

a plate-like individual head member including a first side surface and a plurality of second side surfaces, said first side surface including a plurality of ink jet outlets, said head member including a plurality of ink paths for supplying ink to said ink jet outlets;

a plurality of drive elements positioned at regions of said main surface corresponding to said ink paths for generating pressure in respective ones of said ink paths; and a plurality of electrodes provided for said drive elements for applying a voltage individually to said drive elements, wherein each electrode has one end connected to one of said drive elements, and an other end extending to a neighborhood of any of said second side surfaces, and wherein said plurality of individual heads are stacked in a step-graded manner so that the other ends of said plurality of electrodes are exposed at the neighborhood of said second side surface.

15. The plurality of heads according to claim 14, wherein each of said plurality of individual heads comprises a substrate including a main surface having a plurality of first concaves forming a wall of said plurality of ink paths and a backside surface, and a cover plate including a main surface and a backside surface, said backside surface attached to said main surface of said substrate, and forming said plurality of ink paths with said wall.

16. The plurality of heads according to claim 15, wherein each head is arranged to satisfy the relationship of $$\theta=\sin^{-1}(25400\cdot N/P\cdot X)$$

$$A=(T/\tan\theta)-(P/N)$$

where

P (μm) is a pitch of said plurality of ink jet outlets,

X (dpi) is a resolution at recording,

N (layers) is the number of stacked layers of said plurality of individual heads, θ (rad) is an angle between a scanning direction of said ink jet recording head and an alignment direction of said ink jet outlets of said individual head, T (μm) is a thickness of said individual head, and A (μm) is a shifted amount in stacking said individual heads.

17. The plurality of heads according to claim 15, wherein said main surface of said cover plate forms a main surface of said individual head, and said drive elements deflect said cover plate to generate pressure at respective said plurality of ink paths.

18. The plurality of heads according to claim 17, wherein said substrate includes a plurality of second concaves at a backside surface, greater in size than said drive element, at a position corresponding to respective said drive elements of an adjacent individual head.

19. The plurality of heads according to claim 18, wherein said ink jet recording head is arranged to satisfy a relationship of $$\theta=\sin^{-1}(25400\cdot N/P\cdot X)$$

$$A=(T/\tan\theta)-(P/N)$$

where

P (μm) is a pitch of said plurality of ink jet outlets,

X (dpi) is a resolution at recording,

N (layers) is the number of stacked layers of said plurality of individual heads, θ (rad) is an angle between a scanning direction of said ink jet recording head and an alignment direction of said ink jet outlets of said individual head, T (μm) is a thickness of said individual head, and A (μm) is a shifted amount in stacking said individual heads.

20. The plurality of heads according to claim 17, wherein said ink jet recording head is arranged to satisfy the relationship of $$\theta=\sin^{-1}(25400\cdot N/P\cdot X)$$

$$A=(T/\tan\theta)-(P/N)$$

where

P (μm) is a pitch of said plurality of ink jet outlets,

X (dpi) is a resolution at recording,

N (layers) is the number of stacked layers of said plurality of individual heads, θ (rad) is an angle between a scanning direction of said ink jet recording head and an alignment direction of said ink jet outlets of said individual head, T (μm) is a thickness of said individual head, and A (μm) is a shifted amount in stacking said individual heads.

21. The plurality of heads according to claim 14, wherein said ink jet recording head is arranged to satisfy the relationship of $$\theta=\sin^{-1}(25400\cdot N/P\cdot X)$$

$$A=(T/\tan\theta)-(P/N)$$

where

P (μm) is a pitch of said plurality of ink jet outlets,

X (dpi) is a resolution at recording,

N (layers) is the number of stacked layers of said plurality of individual heads, θ (rad) is an angle between a scanning direction of said ink jet recording head and an alignment direction of said ink jet outlets of said individual head, T (μm) is a thickness of said individual head, and A (μm) is a shifted amount in stacking said individual heads.

22. The plurality of heads according to claim 14, wherein each of said heads comprises a substrate including a backside surface having a plurality of first concaves for forming respective walls of said plurality of ink paths, and a main surface, and a cover plate including a main surface and a backside surface, said backside surface being attached to the backside surface of said substrate, and forming said plurality of ink paths together with said walls.

23. The plurality of heads according to claim 22, wherein said main surface of said substrate forms a main surface of said individual head, said plurality of drive elements are provided at a plurality of second concaves formed at a position corresponding to said plurality of ink paths respectively of said substrate, and each of said plurality of drive elements deflects a plurality of thin body portions between said plurality of first concaves and said second concaves to generate pressure at respective said plurality of ink paths.

24. The plurality of heads according to claim 23, wherein said ink jet recording head is arranged to satisfy the relationship of $$\theta=\sin^{-1}(25400\cdot N/P\cdot X)$$

$$A=(T/\tan\theta)-(P/N)$$

where

P (μm) is a pitch of said plurality of ink jet outlets,

X (dpi) is a resolution at recording,

N (layers) is the number of stacked layers of said plurality of individual heads, θ (rad) is an angle between a scanning direction of said ink jet recording head and an alignment direction of said ink jet outlets of said individual head, T (μm) is a thickness of said individual head, and A (μm) is a shifted amount in stacking said individual heads.

25. The plurality of heads according to claim 22, wherein said ink jet recording head is arranged to satisfy the relationship of $$\theta=\sin^{-1}(25400\cdot N/P\cdot X)$$

$$A=(T/\tan\theta)-(P/N)$$

where

P (μm) is a pitch of said plurality of ink jet outlets,

X (dpi) is a resolution at recording,

N (layers) is the number of stacked layers of said plurality of individual heads, θ (rad) is an angle between a scanning direction of said ink jet recording head and an alignment direction of said ink jet outlets of said individual head, T (μm) is a thickness of said individual head, and A (μm) is a shifted amount in stacking said individual heads.

26. The plurality of heads according to claim 14, wherein each of said plurality of individual head members comprises a substrate including a main surface having a plurality of first concaves forming a wall of said plurality of ink paths, and a cover plate including a main surface and a backside surface, said backside surface attached to said main surface of said substrate, and forming said plurality of ink paths with said wall.

27. An ink jet recording head comprising a plurality of plate-like individual heads, wherein each of said plurality of individual heads comprises:

a plate-like individual head member including a first side surface and a plurality of second side surfaces, said first side surface including a plurality of ink jet outlets, said head member including a plurality of ink paths for supplying ink to said ink jet outlets;

a plurality of drive elements, each positioned at a wall of a respective ink path for generating pressure in said ink path; and a plurality of electrodes provided for said drive elements for applying a voltage individually to said drive elements, wherein each electrode has one end connected to one of said drive elements, and an other end extending to a neighborhood of any of said second side surfaces, and wherein said plurality of individual heads are stacked in a step-graded manner so that the other ends of said plurality of electrodes are exposed at the neighborhood of said second side surface.

28. The ink jet recording head according to claim 27, wherein each of said plurality of individual heads comprises:

a plate-like individual head member including a first side surface and a plurality of second side surfaces, said first side surface including a plurality of ink jet outlets, said head member including a plurality of ink paths for supplying ink to said ink jet outlets;

a plurality of drive elements, each positioned at a wall of a respective ink path for generating pressure in said ink path; and a plurality of electrodes provided for said drive elements for applying a voltage individually to said drive elements, wherein each electrode has one end connected to one of said drive elements, and an other end extending to a neighborhood of any of said second side surfaces, and wherein said plurality of individual heads are stacked in a step-graded manner so that the other ends of said plurality of electrodes are exposed at the neighborhood of said second side surface.

29. The ink jet recording head according to claim 28, wherein each of said plurality of individual head members is constituted by: a substrate including a main surface having a plurality of first concaves forming a wall of said plurality of ink paths, and a backside surface where said drive elements are mounted, and a cover plate including a backside surface attached to said main surface of said substrate and forming said plurality of ink paths with said wall.

30. The ink jet recording head according to claim 28, wherein said backside surface of said substrate includes concaves, said drive elements being mounted in said concaves, and further wherein said cover includes a main surface which attaches to a backside surface of a substrate belonging to another one of said individual head members when stacked.

31. The plurality of heads according to claim 30, wherein said substrate includes a plurality of second concaves at a backside surface, greater in size than said drive element, at a position corresponding to respective said drive elements of an adjacent individual head.

32. The plurality of heads according to claim 31, wherein said ink jet recording head is arranged to satisfy a relationship of $$\theta=\sin^{-1}(25400\cdot N/P\cdot X)$$

$$A=(T/\tan\theta)-(P/N)$$

where

P (μm) is a pitch of said plurality of ink jet outlets,

X (dpi) is a resolution at recording,

N (layers) is the number of stacked layers of said plurality of individual heads, θ (rad) is an angle between a scanning direction of said ink jet recording head and an alignment direction of said ink jet outlets of said individual head, T (μm) is a thickness of said individual head, and A (μm) is a shifted amount in stacking said individual heads.

33. The plurality of heads according to claim 30, wherein said ink jet recording head is arranged to satisfy the relationship of $$\theta=\sin^{-1}(25400\cdot N/P\cdot X)$$

$$A=(T/\tan\theta)-(P/N)$$

where

P (μm) is a pitch of said plurality of ink jet outlets,

X (dpi) is a resolution at recording,

N (layers) is the number of stacked layers of said plurality of individual heads, θ (rad) is an angle between a scanning direction of said ink jet recording head and an alignment direction of said ink jet outlets of said individual head, T (μm) is a thickness of said individual head, and A (μm) is a shifted amount in stacking said individual heads.

34. The plurality of heads according to claim 27, wherein said ink jet recording head is arranged to satisfy the relationship of $$\theta=\sin^{-1}(25400\cdot N/P\cdot X)$$

$$A=(T/\tan\theta)-(P/N)$$

where

P (μm) is a pitch of said plurality of ink jet outlets,

X (dpi) is a resolution at recording,

N (layers) is the number of stacked layers of said plurality of individual heads, θ (rad) is an angle between a scanning direction of said ink jet recording head and an alignment direction of said ink jet outlets of said individual head, T (μm) is a thickness of said individual head, and A (μm) is a shifted amount in stacking said individual heads.

35. The plurality of heads according to claim 27, wherein each of said heads comprises a substrate including a backside surface having a plurality of first concaves for forming respective walls of said plurality of ink paths, and a main surface, and a cover plate including a main surface and a backside surface, said backside surface being attached to the backside surface of said substrate, and forming said plurality of ink paths together with said walls.

36. The plurality of heads according to claim 35, wherein said main surface of said substrate forms a main surface of said individual head, said plurality of drive elements are provided at a plurality of second concaves formed at a position corresponding to said plurality of ink paths respectively of said substrate, and each of said plurality of drive elements deflects a plurality of thin body portions between said plurality of first concaves and said second concaves to generate pressure at respective said plurality of ink paths.

37. The plurality of heads according to claim 36, wherein said ink jet recording head is arranged to satisfy the relationship of $$\theta=\sin^{-1}(25400\cdot N/P\cdot X)$$

$$A=(T/\tan\theta)-(P/N)$$

where

P (μm) is a pitch of said plurality of ink jet outlets,

X (dpi) is a resolution at recording,

N (layers) is the number of stacked layers of said plurality of individual heads, θ (rad) is an angle between a scanning direction of said ink jet recording head and an alignment direction of said ink jet outlets of said individual head, T (μm) is a thickness of said individual head, and A (μm) is a shifted amount in stacking said individual heads.

38. The plurality of heads according to claim 35, wherein said ink jet recording head is arranged to satisfy the relationship of $$\theta=\sin^{-1}(25400\cdot N/P\cdot X)$$

$$A=(T/\tan\theta)-(P/N)$$

where

P (μm) is a pitch of said plurality of ink jet outlets,

X (dpi) is a resolution at recording,

N (layers) is the number of stacked layers of said plurality of individual heads, θ (rad) is an angle between a scanning direction of said ink jet recording head and an alignment direction of said ink jet outlets of said individual head, T (μm) is a thickness of said individual head, and A (μm) is a shifted amount in stacking said individual heads.

39. The ink jet recording head according to claim 27, wherein each of said plurality of individual head members is constituted by: a substrate including a main surface having a plurality of first concaves forming a wall of said plurality of ink paths, and a backside surface where said drive elements are mounted, and a cover plate including a backside surface attached to said main surface of said substrate and forming said plurality of ink paths with said wall.

40. The ink jet recording head according to claim 39, wherein said backside surface of said substrate includes concaves, said drive elements being mounted in said concaves, and further wherein said cover includes a main surface which attaches to a backside surface of a substrate belonging to another one of said individual head members when stacked.

* * * * *